US011522315B2

(12) United States Patent
Moreau

(10) Patent No.: US 11,522,315 B2
(45) Date of Patent: Dec. 6, 2022

(54) ELECTRICAL CONNECTOR ASSEMBLY

(71) Applicant: Connecteurs Electriques Deutsch, Evreux (FR)

(72) Inventor: Jean-Luc Moreau, Evreux (FR)

(73) Assignee: Connecteurs Electriques Deutsch, Evreux (FR)

( * ) Notice: Subject to any disclaimer, the term of this patent is extended or adjusted under 35 U.S.C. 154(b) by 8 days.

(21) Appl. No.: 17/095,459

(22) Filed: Nov. 11, 2020

(65) Prior Publication Data

US 2021/0143579 A1 May 13, 2021

(30) Foreign Application Priority Data

Nov. 11, 2019 (EP) ..... 19306460

(51) Int. Cl.

| | |
|---|---|
| ***H01R 13/62*** | (2006.01) |
| ***H01R 13/627*** | (2006.01) |
| ***H01R 13/516*** | (2006.01) |
| ***H01R 13/74*** | (2006.01) |
| ***H01R 43/26*** | (2006.01) |
| *H01R 13/64* | (2006.01) |

(52) U.S. Cl.

CPC ..... *H01R 13/6275* (2013.01); *H01R 13/516* (2013.01); *H01R 13/745* (2013.01); *H01R 43/26* (2013.01); *H01R 13/64* (2013.01)

(58) Field of Classification Search

CPC ..... H01R 13/516; H01R 13/6275; H01R 13/745; H01R 43/26; H01R 13/64

USPC ..... 439/304

See application file for complete search history.

(56) References Cited

U.S. PATENT DOCUMENTS 3,488,622 A * 1/1970 Gley ..... H01R 13/629 439/157
4,875,873 A 10/1989 Ishizuka et al.
5,035,634 A * 7/1991 Hasircoglu ..... H01R 13/62972 439/157
5,230,635 A * 7/1993 Takenouchi ..... H01R 13/62938 439/153
5,326,279 A * 7/1994 Sumida ..... H01R 13/62933 439/157
5,376,016 A * 12/1994 Inaba ..... H01R 13/6273 439/364
5,401,179 A * 3/1995 Shinchi ..... H01R 13/62955 439/372
5,425,654 A 6/1995 Colleran et al.
(Continued)

OTHER PUBLICATIONS

Extended European Search Report, dated Apr. 30, 2020, 8 pages.

*Primary Examiner* — Abdullah A Riyami
*Assistant Examiner* — Vladimir Imas
(74) *Attorney, Agent, or Firm* — Barley Snyder

(57) ABSTRACT

An electrical connector assembly includes a receptacle housing having a retaining device with a coupling hook portion and a plug housing configured to be mated and locked with the receptacle housing. The plug housing has a lever movable from a first position in which the plug housing and the receptacle housing are unlocked to a second position in which the plug housing is locked with the receptacle housing. The lever is rotatably mounted about a shaft arranged in and passing through the plug housing. The coupling hook portion is configured to engage with the shaft and, in the second position, the shaft is in abutment with the coupling hook portion to positively lock the plug housing and the receptacle housing together.

20 Claims, 5 Drawing Sheets

(56) References Cited

U.S. PATENT DOCUMENTS 5,474,462 A * 12/1995 Yamanashi ..... H01R 13/62933 439/153
5,681,175 A * 10/1997 Busse ..... H01R 13/62977 439/372
5,711,682 A * 1/1998 Maejima ..... H01R 13/62933 439/157
6,102,717 A * 8/2000 Aoki ..... H01R 13/193 439/157
6,174,179 B1 * 1/2001 Okabe ..... H01R 13/62955 439/157
6,183,278 B1 * 2/2001 Hirasawa ..... H01R 13/62933 439/157
6,213,791 B1 * 4/2001 Kodama ..... H01R 13/62905 439/157
6,361,336 B1 * 3/2002 Zhao ..... H01R 13/62938 439/157
6,592,384 B2 * 7/2003 Sawayanagi ..... H01R 13/5202 439/157
6,695,640 B2 * 2/2004 Uchibori ..... H01R 13/701 439/911
6,755,674 B2 * 6/2004 Fujii ..... H01R 13/62938 439/372
7,201,591 B2 * 4/2007 Fujii ..... H01R 13/639 439/157
7,329,132 B1 2/2008 Kamath et al.
7,854,619 B2 * 12/2010 Takahashi ..... H01R 13/62938 439/157
2013/0336706 A1 * 12/2013 Oshita ..... H01R 13/631 403/11
2014/0235081 A1 * 8/2014 Shimizu ..... H01R 13/64 439/157
2016/0172788 A1 * 6/2016 Iida ..... H01R 13/62933 439/157
2018/0366874 A1 12/2018 Yamada et al.
2020/0395712 A1 * 12/2020 Brennauer ..... H01R 13/6273

* cited by examiner

ELECTRICAL CONNECTOR ASSEMBLY

CROSS-REFERENCE TO RELATED APPLICATION

This application claims the benefit of the filing date under 35 U.S.C. § 119(a)-(d) of European Patent Application No. 19306460, filed on Nov. 11, 2019.

FIELD OF THE INVENTION

The present invention relates to an electrical connector assembly and, more particularly, to an electrical connector assembly for blind mating.

BACKGROUND

Electrical connectors can be used to electrically interconnect two mating housings together, each mating housing comprising wires coupled to male or female terminals. When the two mating housings are coupled together, the male and female terminals engage with one another to electrically interconnect the wires. To ensure and maintain the mating housings connected together, e.g. by a coupling screw, in particular when the electrical connector assembly is installed into a vehicle prone to vibrations, a bundle of screws and/or bolts, such as fixing screws are used for fixing the assembly to the vehicle.

However, the use of screws/bolts, in addition to increasing the number of detachable components per electrical connector assembly, involves assembly steps that may require at least two operators. Further, the application of a specific torque is not easily controllable, and thus, does not allow saving assembly times. Moreover, during use, vibration or chocks might untighten the screws—the loose screws being able to cause severe damage.

An alternative solution for interlocking housings without screws relies on the use of a lever movably mounted around protrusions extending from opposite faces of a housing. Furthermore, as the coupling effort is essentially localized at the protrusions extending from the opposite faces of the housing when the lever is moved, such mechanism allows a restricted number of mating and unmating operations, as each operation may further weaken the lever. Furthermore, in a blind electrical connector assembly situation, the mating of the terminals when coupling the two mating housings together is invisible to the operator. Thus, in blind connectors, the proper and complete coupling of the mating housings and of their terminals can be difficult to realize and it remains difficult to check proper assembly.

SUMMARY

An electrical connector assembly includes a receptacle housing having a retaining device with a coupling hook portion and a plug housing configured to be mated and locked with the receptacle housing. The plug housing has a lever movable from a first position in which the plug housing and the receptacle housing are unlocked to a second position in which the plug housing is locked with the receptacle housing. The lever is rotatably mounted about a shaft arranged in and passing through the plug housing. The coupling hook portion is configured to engage with the shaft and, in the second position, the shaft is in abutment with the coupling hook portion to positively lock the plug housing and the receptacle housing together.

BRIEF DESCRIPTION OF THE DRAWINGS

The invention will now be described by way of example with reference to the accompanying Figures, of which.

DETAILED DESCRIPTION OF THE EMBODIMENT(S)

In the description, reference is made to the accompanying figures that are meant to illustrate embodiments of the invention. It is understood that such embodiments do not represent the full scope of the invention. The accompanying drawings are incorporated into the specification and form a part of the specification to illustrate several embodiments of the present invention. These drawings, together with the description, serve to explain the principles of the invention. The drawings are merely for the purpose of illustrating the examples of how the invention can be made and used, and are not to be construed as limiting the invention to only the illustrated and described embodiments. Furthermore, several aspects of the embodiments may form—individually or in different combinations—solutions according to the present invention. The following described embodiments thus can be considered either alone or in an arbitrary combination thereof. Features and advantages will become apparent from the following more particular description of the various embodiments of the invention, as illustrated in the accompanying drawings, in which like references refer to like elements.

Figure 1:
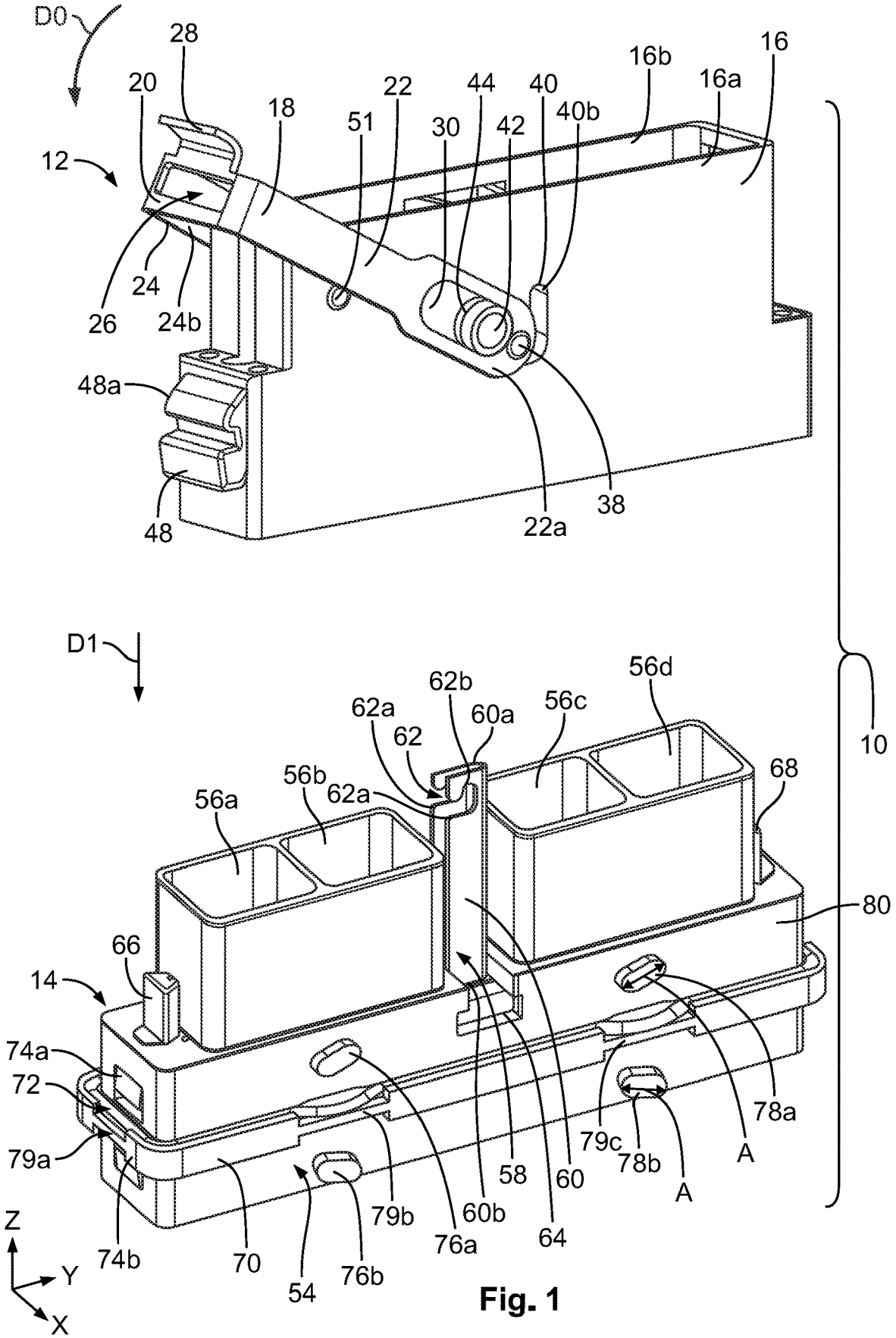
FIG. 1 is a perspective view of an electrical connector assembly according to an embodiment in a disassembled state.

FIG. 1 illustrates an electrical connector assembly 10 according to the present invention. The electrical connector assembly 10 comprises a plug housing 12, a mating receptacle housing 14, and a fixation frame bracket 100 (which will be described hereafter with respect to FIG. 3). The plug housing 12 is configured to be mated with the receptacle housing 14 relative to an insertion direction shown by an arrow D1 in FIG. 1. In FIG. 1, the insertion direction D1 has been represented parallel to the axis Z of the Cartesian coordinate system.

The electrical connector assembly 10 is represented in a disassembled state in FIG. 1. In the disassembled state, the plug housing 12 is not mated with the receptacle housing 14.

In the following, the plug housing 12 is described in greater detail with respect to FIG. 1 and FIG. 2, which illustrates an exploded view of the plug housing 12.

Figure 2:
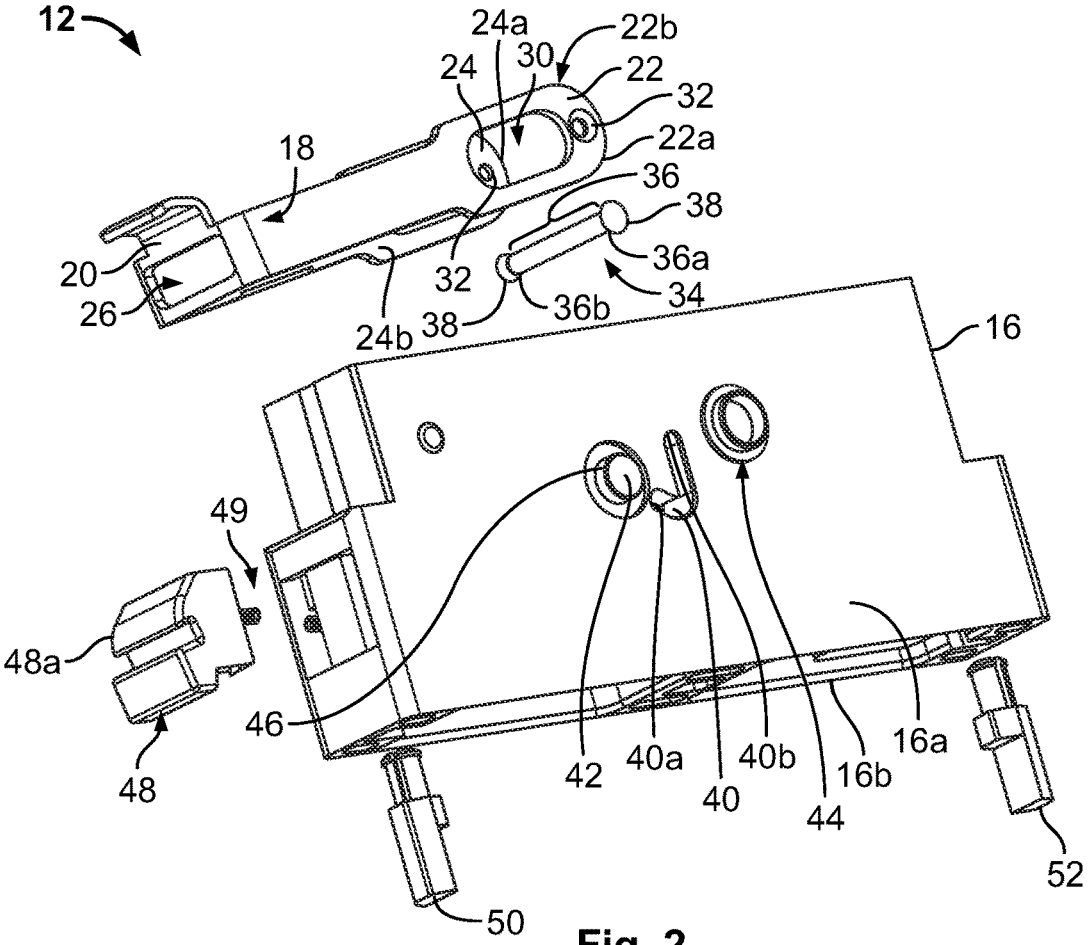
FIG. 2 is an exploded perspective view of a plug housing of the electrical connector assembly.

The plug housing 12, as shown in FIGS. 1 and 2, includes a body 16. The body 16 is formed from a mold material made of thermoplastic composite, such as a resin lightweight composite. In a variant, the body 16 may be a metalized plastic housing. The cross-sections of the body 16 in the planes defined by the axis (X, Y), (X, Z) and (Y,Z) of the Cartesian coordinate system illustrated in FIG. 1, have an essentially rectangular form.

The plug housing 12 has a lever 18, as shown in FIGS. 1 and 2. The lever 18 is formed of an essentially U-shaped piece comprising a central section 20 from which extend perpendicularly two lateral sections 22, 24—so as to form the U-shape. Hence, the two lateral sections 22, 24 have respective free ends 22*a*, 24*a* (24*a* is only visible in FIG. 2). The lever 18, in an embodiment, is made of plastic and can be formed by injection molding in a one-shot process. The central section 20 of the lever 18 has an opening 26 and a handle 28 extending perpendicularly from the central section 20 to simplify manipulation of the lever 18 by an operator.

The lateral sections 22, 24 of the lever 18 are symmetrical by mirror symmetry. Thus, the description hereafter of the lateral section 22 applies likewise to the lateral section 24 by symmetry. As a result, the same reference numerals are used to describe the characteristics of both the lateral sections 22, 24. However, in a variant embodiment not illustrated, the lateral sections 22, 24 of the lever 18 may be asymmetrical.

As illustrated in FIGS. 1 and 2, the lateral section 22 of the lever 18 has towards its free end 22*a* an oblong through-hole 30. The oblong through-hole 30 is elongated in the direction of extension of the lateral section 22 from the central section 20. In a variant, the lateral section 22 of the lever 18, in particular an internal face 22*b* of the lateral section 22 facing the internal face 24*b* of the lateral section 24, may have, instead of the oblong through-hole 30, an oblong recess, that is to say a non-traversing opening.

The lateral section 22 further comprises, between the oblong through-hole 30 and the free end 22*a*, a through-hole 32, in particular a chamfered circular through-hole 32 (only visible in FIG. 2). The center of the circular through-hole 32 is aligned with the elongated axis of the oblong through-hole 30. Each circular through-hole 32 of the lateral sections 22, 24 is designed and dimensioned for receiving a shaft 34.

The shaft 34, as shown in FIG. 2, is made of a main section 36 comprising a cylindrical axle 36 with a circular cross-section complementary to the circular through-hole 32. The shaft 34 further comprises, at each of the free-ends 36*a*, 36*b* of the main section 36, caps 38 having a cross-section greater than the area of the circular through-hole 32. At least one of the caps 38 is a clip-on cap 38 such that the main section 36 of the shaft 34 can be inserted through one of the circular through-holes 32. The shaft 34 can be maintained by clipping the cap(s) 38 to one or each free end 36*a*, 36*b* of the main section 36, such that each lateral section 22, 24 is interposed and is held between the main section 36 and the corresponding cap 38 of the shaft 34. The shaft 34 can be advantageously mounted to the plug housing 12 without using any screws and/or bolts by a positive-fit assembly.

The body 16 of the plug housing 12 further comprises two parallel and symmetrical lateral faces 16*a*, 16*b*, as shown in FIGS. 1 and 2, each being provided with an opening 40. The body 16 and the two symmetrical openings 40 are configured for receiving therethrough the shaft 34. FIG. 1 represents a view wherein the shaft 34 of the lever 18 is mounted within the openings 40 in a direction parallel to the axis X of the Cartesian coordinate system. As represented in FIG. 1, in a plane defined by the axis (Y, Z) of the Cartesian coordinate system, i.e. in a plane being transversal to a longitudinal axis of the shaft 34 when the shaft 34 is accommodated through the openings 40 and the body 16, the cross-section of each opening 40 is essentially J-shaped (see FIG. 2). The dimension of the J-shaped opening 40 are proportional to the dimension of the shaft 34, so that the shaft 34 can be movable within the openings 40 of the plug housing 12. The shaft 34 is movable within the openings 40 from a first position, wherein the shaft abuts on a first end 40*a* of each J-shape opening 40 to a second position wherein the shaft 34 abuts on a second end 40*b*, opposite to the first end 40*a*, of each J-shape opening 40 of the plug housing 12. As it will be explained in further detail with respect to the FIGS. 4*a*-4*e*, the J-shaped openings 40 infer a specific trajectory to the shaft 34, complementary to a coupling portion of the receptacle 14. In a variant, instead of a J-shape, the openings 40 may have a V-shape, a U-shape, a C-shape or a hook shape.

Each lateral face 16*a*, 16*b* of the body 16 of the plug housing 12 further comprises a circular protrusion 42 extending perpendicularly from the lateral face 16*a*, 16*b* (i.e. along a direction parallel to the axis X of the Cartesian coordinate system in FIG. 1). The protrusions 42 are dimensioned so as to be accommodatable in the oblong through-holes 30 of the lever 18. A bearing 44, fitted around each protrusion 42 between the lateral face 16*a* (16*b*) and the lever 18 simplifies the movement of the lever 18 with respect to the plug housing (12). The bearing 44 of each lateral faces 16*a*, 16*b* is accommodated in a recess 46 of the lateral face 16*a* (16*b*) which surrounds the protrusion 42. Hence, the lever 18 is movably mounted to the plug housing 12 and motion is guided without using any screws and/or bolts by a positive-fit assembly.

As shown in FIGS. 1 and 2, the plug housing 12 has a locking button 48 with a protruding portion 48*a*, nose-shape, which serves as a locking device 48 for locking the lever 18 in a position wherein the electrical connector assembly 10 is mated. The locking button 48, as illustrated in FIG. 2, is a distinct element from the plug housing 12 and is, in this embodiment, snap-fitted to the plug housing 12 when the protruding part 48*a* is arranged in and abuts on the opening 26 of the lever 18. Hence, the locking button 48 can be advantageously mounted to the plug housing 12 without using any screws and/or bolts by a snap-fit assembly. The locking button 48 corresponds to a spring loaded locking mechanism as it comprises a spring 49, in particular a torsion spring 49 (only visible in FIG. 2), so as to be pushable relative to the plug housing 12 through the opening 26 of the lever 18 by an operator for the purpose of allowing an unlocking of the lever 18. The locking button 48 also serves as a visual indicator so that an operator can quickly and easily ascertain the locking of the electrical connector assembly 10.

Each lateral faces 16*a*, 16*b* further comprises a protuberance 51, shown in FIG. 1, serving as a hard point at the beginning of movement of the lever 18. Hence, the protuberance 51 helps to prevent unintentional movement of the lever 18 in the direction D0, for example during the transport of the connector.

The plug housing 12 further comprises two misplug-proof mechanisms 50, 52, shown in FIG. 2. The misplug-proof mechanisms 50, 52 prevent an operator from mating the plug housing 12 with the receptacle housing 14 in a wrong way. In the embodiment represented in FIG. 2, the misplug-proof mechanisms 50, 52 can be oriented by an operator in six different positions. If one of the misplug-proof mechanisms 50, 52 is not correctly oriented, a mating of the plug housing 12 and the receptacle housing 14 is prevented, therefore avoiding an erroneous coupling.

The receptacle housing 14 will be described in the following with respect to the FIG. 1. The receptacle housing 14 comprises a body 54. The body 54, as the body 16 of the plug housing 12, is formed from a mold material made of thermoplastic composite, such as a resin lightweight composite. In a variant, the body 54 may be a metalized plastic housing. The body 54 of the receptacle housing 14 has a shape and geometry complementary to the body 16 of the plug housing 12, so that the receptacle housing 14 and the plug housing 12 can be mated together.

In the embodiment represented by the FIG. 1, the body 54 of the receptacle housing 14 comprises four hollow compartments 56*a*, 56*b*, 56*c*, 56*d*—each of them being configured for accommodating a module provided with electrical contact pins (not represented in FIG. 1). The compartments 56*a-d* are complementary to compartments of the body 16 of the plug housing 12 (which are not visible in FIGS. 1 and 2). The body 14 and the hollow compartments 56*a*, 56*b*, 56*c*, 56*d* are integrally formed together. The plug housing 12 and the receptacle housing 14 are adapted for scoop-proof connectors. Indeed, as can be seen in the FIG. 1, the compartments 56*a*-56*d* of the body 54 provide scoop proof "domes", i.e. the compartment's walls, which are comprised in the body 14, are dimensioned so as to be higher than the length of the contact pins accommodated into it—which prevent damage to exposed contact pins during mating. Hence, exposed contact pins of the modules are protected from being accidently bent during mating. The same is true for the plug housing 12.

The receptacle housing 14 has a retaining device 58, as shown in FIG. 1. The retaining device 58 is a hollow elongated beam 60 having an essentially U-shaped cross-section and provided towards one end 60*a* of the beam 60 with a coupling hook portion 62. The coupling hook portion 62 is dimensioned and configured to engage with the shaft 34 of the plug housing 12. The coupling hook portion 62 comprises an open-end 62*a* and a closed end 62*b*. An end 60*b*, opposite to the end 60*a* of the elongated beam 60, is snap-fitted to a corresponding portion 64 of the body 54 of the receptacle housing 14. Hence, the snap-fit assembly of the retaining device 58 with the receptacle housing 14 allows using a quick, easy, and screw-less assembly technique. The elongated beam 60 extends perpendicularly with respect to the portion 64 of the body 54 along a direction parallel to the insertion direction D1, i.e. parallel to a direction along the axis Z of the Cartesian coordinate system.

As shown in FIG. 1, the body 54 of the receptacle housing 64 is surrounded by a support surface 70, here in the form of a gutter 70, upon which a panel can be laid. In this embodiment, an O-ring 72 can be inserted into the gutter 70 to improve the mounting of the assembly onto the panel, e.g. to reduce vibrations. The O-ring 42 can be made of a conductive material to provide electrical continuity despite the presence of a panel and to ensure electromagnetic shielding.

The body 54 of the receptacle housing 64 further comprises tabs 74*a*, 74*b*—each on both sides of the gutter 70 as shown in FIG. 1. The tabs 74*a*, 74*b* are protrusions that extend from the body 54 so as to allow maintaining a panel for example, on either side of the gutter 70 by snap-fit, in particular before the assembly is locked. Indeed, the receptacle housing 14 is designed such that a panel can be inserted along the insertion direction D1 from either side of the body 54. That is why the tabs 74*a*, 74*b* are symmetrical by mirror symmetry relative to a plan defined by the gutter 70.

The body 14 further comprises oblong protrusions 76*a*, 76*b* and 78*a*, 78*b* extending perpendicularly from a lateral face 80 of the body 54 along a direction perpendicular to the insertion direction D1, i.e. along a direction parallel to the axis X of the Cartesian coordinate system. The oblong protrusions 76*a*, 76*b* and 78*a*, 78*b* are symmetrical by mirror symmetry relative to a plan defined by the gutter 70. Oblong protrusions are also provided in a symmetrical manner on a lateral face opposite to the face 80, which is not visible in FIG. 1. Under and above the tabs 74*a*, 74*b* and the oblong protrusions 76*a*, 76*b* and 78*a*, 78*b*, the gutter 70 is partially recessed 79*a*, 79*b*, 79*c* for facilitating the molding of the receptacle housing 14.

The greater axis A of the oblong protrusions 76*a*, 76*b* and 78*a*, 78*b* is essentially oriented at 75° or 105° with respect to the axis Z of the Cartesian coordinate system, i.e. with respect to the insertion direction D1, as shown in FIG. 1. The oblong protrusions 76*a*, 76*b* and 78*a*, 78*b* are dimensioned so as to be complementary to grooves of the fixation bracket frame 100 than can be mounted on the receptacle housing 14.

Figure 3:
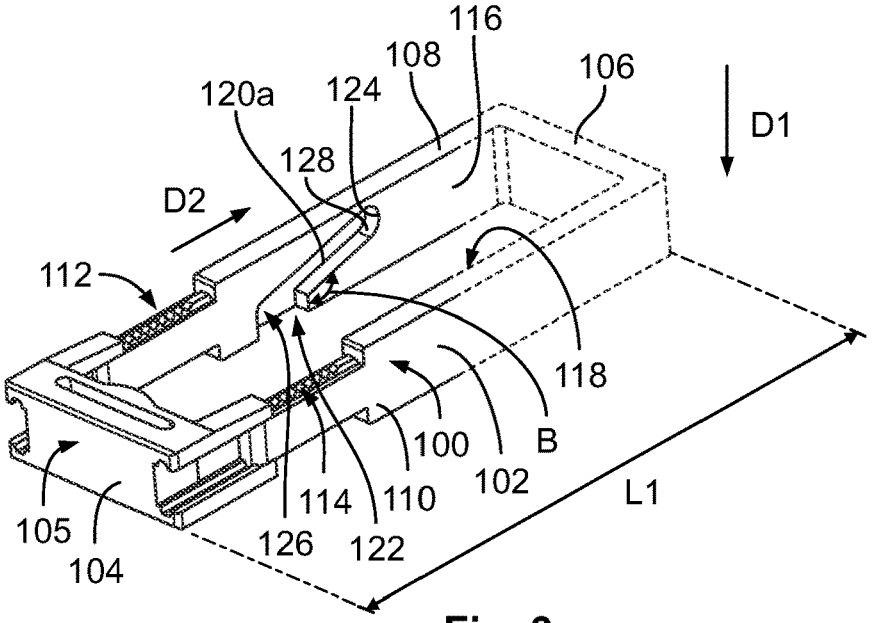
FIG. 3 is a perspective view of a fixation bracket frame according to an embodiment.

The fixation bracket frame 100 is described hereafter with respect to FIG. 3. The fixation bracket frame 100 is an essentially retractable rectangular frame 102. The frame 100 is formed from a mold material made of thermoplastic composite, such as a resin lightweight composite. At least one 104 of the shorter sides 104, 106 of the fixation bracket frame 100 comprises a U-shaped securing clip 105 movable relative to the longer sides 108, 110 of the frame 100 in translation along a direction D2 represented by an arrow in FIG. 3. Hence, a translation of the securing clip 105 with respect to the longer sides 108, 110 allows modifying the length L1 of the longer sides 108, 110 of the frame 100. In a primary position, wherein the frame 100 is not or partially retracted, the length L1 is greater than in a secondary position, wherein the frame 100 is further retracted by a translation of the securing clip 105. In a variant, the retractable and securing clip may be provided instead on one of the longer sides 108, 110 of the fixation bracket frame 10. A position of the securing clip 105 relative to the frame 100 can be maintained by locking detents 112, 114 provided on the longer sides 108, 110. Hence, the securing clip 105 can be advantageously locked in a predetermined position without using any screws and/or bolts, but by a snap-fit assembly using locking detents 112, 114. Moreover, the securing clips 105 provide visual indicators for easily ascertaining the locking of the fixation bracket frame 100. In FIG. 3, the securing clip 105 is represented in an unlocked position. In a variant, both shorter sides 104, 106 of the frame 100 may be provided with securing clips.

The fixation bracket frame 100 further comprises, in the inner walls 116, 118 of the respective longer sides 108, 110 of the frame 100, grooves 120*a-d* (only the groove 120*a* is visible in FIG. 3). The grooves 120*a* (120*b* is not visible in FIG. 3) on the side 108, 116 are symmetrical by mirror symmetry to the grooves (120*c*, 120*d* is not visible in FIG. 3) of the opposite side 110, 118. Each groove 120*a-d* has an open-end 122 and a closed end 124. Towards the open-end 122, each groove 120*a-d* has a first portion 126 with an essentially rectangular cross-section allowing a movement in the insertion direction D1 when the fixation bracket frame 100 is mounted on the receptacle housing 14. Towards the closed end 124, each groove 120*a-d* has a second elongated portion 128. Each groove 120*a-d* is essentially arm-shaped, in particular an arm forming an angle B around 100°-135°, in particular 105°, so that the first portion 126 is not aligned with the second portion 128. Hence, the fixation frame bracket 100 can be moved relative to the receptacle housing 14 according to two different directions that are not parallel to each other, as further explained with respect to FIG. 4*b*.

The receptacle housing 14 further comprises two misplug-proof mechanisms 66, 68, shown in FIG. 1, complementary to the misplug-proof mechanisms 50, 52 (only visible in FIG. 2) of the plug housing 12. The misplug-proof mechanisms 50, 52, 66, 68 allow preventing an operator from mating the plug housing 12 with the receptacle housing 14 in a wrong way. An operator can position the misplug-proof mechanisms 50, 52, 66, 68 in different positions.

The grooves 120*a-d* are dimensioned so that the protrusions 76*a-b* and 78*a-b* of the receptacle housing 14 can be accommodated and slides into it, as further explained in reference to FIGS. 4*a-e*.

FIGS. 4*a* to 4*e* illustrate the steps of a method for assembling the electrical connector assembly 10 according to the present invention. Elements with the same reference numeral already described and illustrated in FIGS. 1 to 3 will not be described in detail again but reference is made to their description above.

Figure 4A:
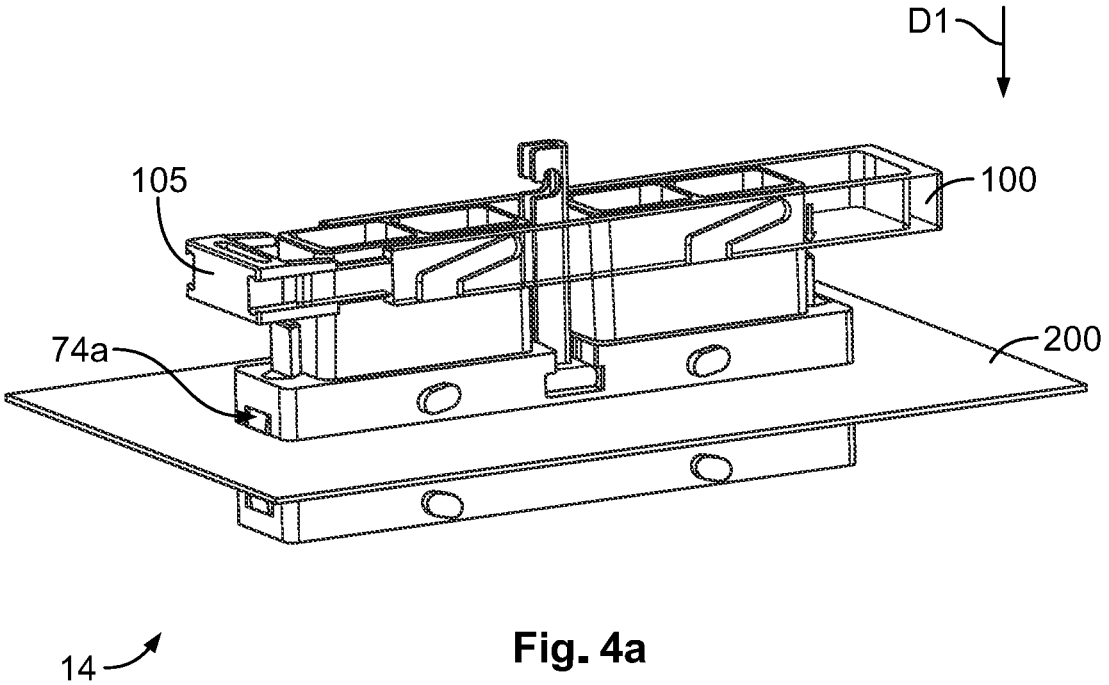
FIG. 4*a* is a perspective view of a first step for assembling the electrical connector assembly.

At the step illustrated by FIG. 4*a*, the receptacle housing 14 is inserted into a corresponding opening in a panel 200 along the insertion direction D1 until the panel 200 abuts on the gutter 70 (not visible in FIG. 4*a* but illustrated in FIG. 1). The panel 200 is then maintained between the tab 74*a* and the gutter 70 of the receptacle housing 14. In a variant, the panel 200 may be inserted in a direction opposite to the insertion direction of D1. In this case, it will abut on the other side of the gutter 70. The electrical connector assembly 10 is advantageously configured for different thickness of the panel 200, such as for a panel 200 having a thickness between 0.7 mm and 2 mm.

The fixation bracket frame 100 is then slid onto the receptacle housing 14 along the insertion direction D1 with the securing clip 105 in the unlocked position. At the step illustrated by FIG. 4*b*, the fixation bracket frame 100 is further pushed along the insertion direction D1 so that the protrusions 76*a-b* are accommodated in the corresponding grooves 120*c*, 120*d* of the fixation bracket frame 100 (by symmetry, the same is true regarding the grooves 120*a*, 120*b* not visible in FIG. 4*b*). While inserting the fixation bracket frame 100, the protrusions 76*a-b* are introduced via the open-end 122 of each groove 120*a-b* and slid first towards the first portion 126 along the insertion direction D1.

Figure 4B:
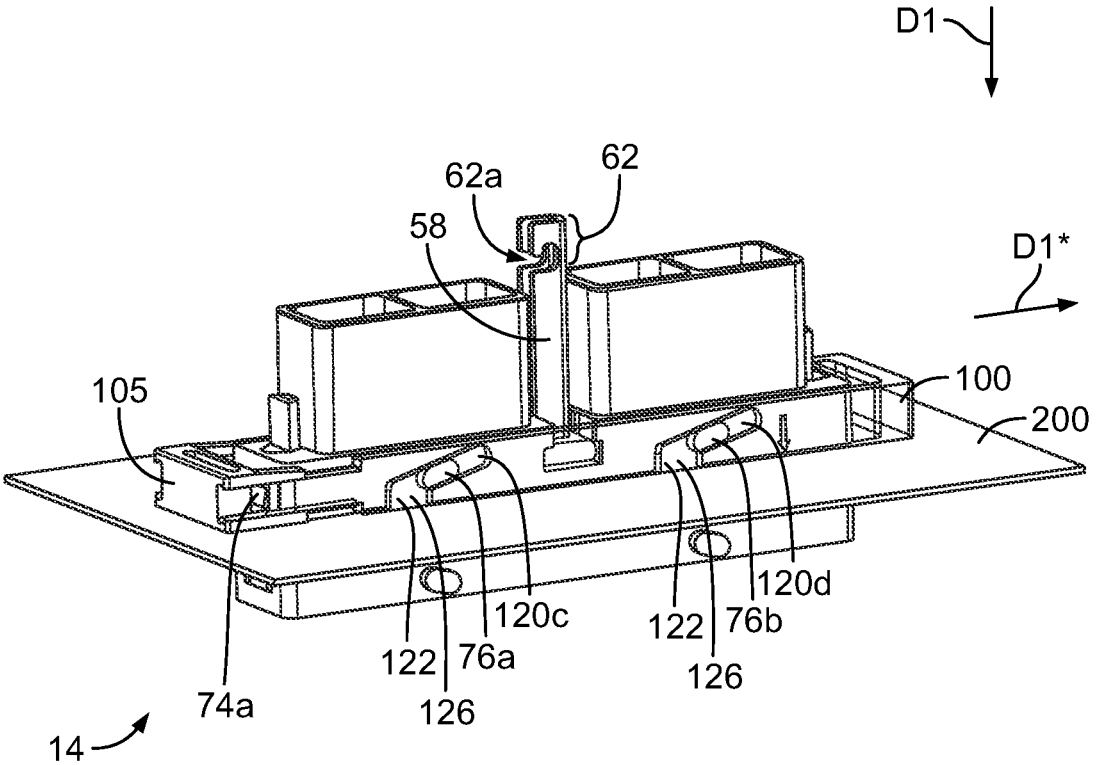
FIG. 4*b* is a perspective view of a second step for assembling the electrical connector assembly.

Then, an operator continues pushing the fixation bracket frame 100 so that the protrusions 76*a-b* slide through the second elongated portion 128 of each groove 120*a-b*. Hence, the fixation bracket frame 100 is shifted with respect to the receptacle housing 14 when the protrusions 76*a-b* slide through the second elongated portion 128 along a direction D1* shown in FIG. 4*b*, different from the direction D1. The arm-shaped profile of the grooves 120*a-b* allows a progressive tightening of the panel 200. In FIG. 4*b*, the fixation bracket frame 100 is still in an unlocked position.

Figure 4C:
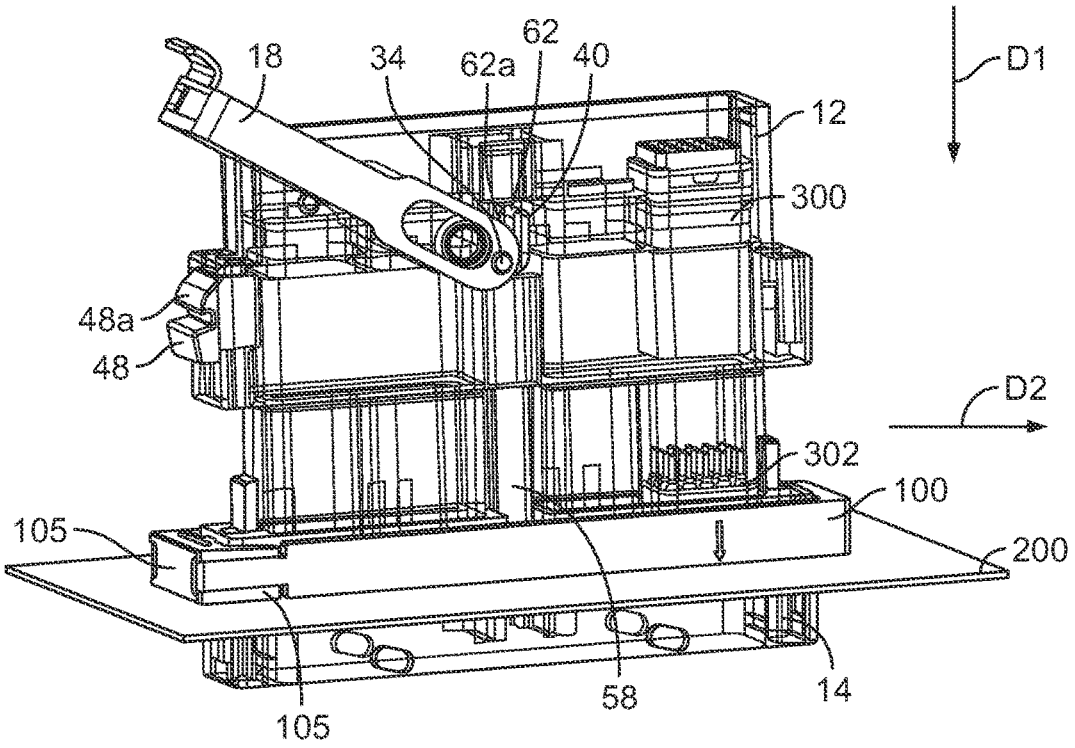
FIG. 4*c* is a partially transparent perspective view of a third step for assembling the electrical connector assembly.

At the step illustrated by FIG. 4*c*, the fixation bracket frame 100 is in its locked position. In the locked position of the fixation bracket frame 100, the protrusions 76*a-b* (not visible in FIG. 4*c*) of the receptacle housing 14 are in abutment with the close end 124 of each groove 120*a-b* (not visible in FIG. 4*c*) of the fixation bracket frame 100. Further, the securing clip 105 of the fixation bracket frame 100 has been slid along the direction D2 so as to first retract the fixation bracket frame 100 from its primary position to its secondary position so as fit tightly around the body 54 of the receptacle housing 14, and secondly to lock, by a snap-fit connection (using the locking detents 112, 114—not visible in FIG. 4*c*), the frame 100 around the receptacle housing 14.

Moreover, at the step illustrated by FIG. 4*c*, the plug housing 12 is inserted along the insertion direction D1 on the receptacle housing 14. The lever 18 of the plug housing 12 is in an unlocked position, corresponding to a state wherein the plug housing 12 and the receptacle housing 14 are not mated and/or locked together. The shaft 34 of the lever 18 is engaged with the coupling hook portion 62 of the retaining device 58 of the receptacle housing 14 via the open-end 62*a* of the hook portion 62. As can be seen in FIG. 4*c* by transparency, a module 300 of the plug housing 12 and a corresponding module 302 of the receptacle 14 are not yet mated.

Figure 4D:
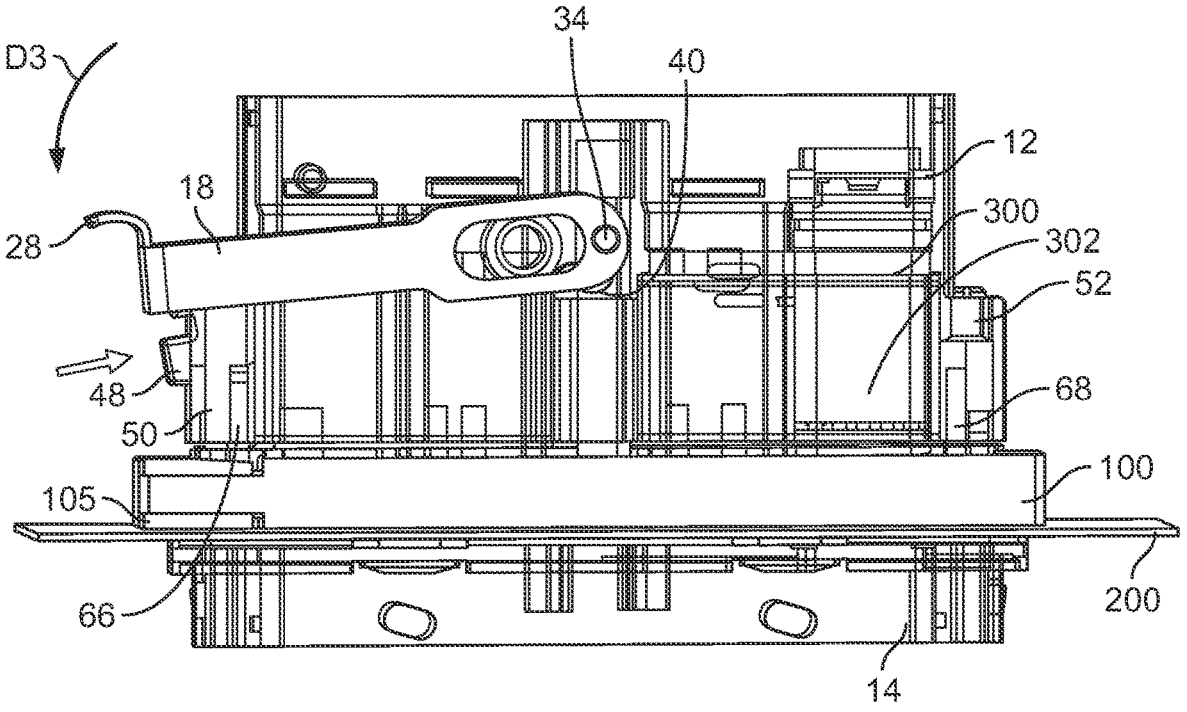
FIG. 4*d* is a partially transparent side view of a fourth step for assembling the electrical connector assembly.

At the step illustrated by FIG. 4*d*, the lever 18 is moved, in particular by an operator by the handle 28, along a direction D3 represented by an arrow in FIG. 4*d*. This movement is guided by the bearing 44, the circular protrusion 42, and the oblong through-hole 30 of the plug housing 12, as previously described with respect to FIGS. 1 and 2. The motion of the lever 18 along the direction D3 provides a displacement of the shaft 34 within the J-openings 40 of the plug housing 12 so as to further engage the shaft 34 within the coupling hook portion 32 of the retaining device 58. The J-shaped opening 40 contributes to allow the abutment of the shaft 34 in the hook portion 32. The shaft's lever 18 and the J-shape opening 40 indicate to an operator that a position, i.e. first or second, is reached when the shaft 34 is in abutment. Furthermore, depending on the position of the shaft's lever 18 with respect to the ends of the opening 40, a visual indication is provided to an operator about the position of the lever 18 (first or second position), thus visually indicating to the operator if the plug housing 12 is locked with the receptacle housing 14 or not.

In the step of FIG. 4*d*, the module 300 of the plug housing 12 and the corresponding module 302 of the receptacle 14 are not yet mated. Furthermore, the misplug mechanisms 50, 52 of the plug housing 12 are not yet connected with the corresponding misplug mechanisms 66, 68 of the receptacle housing 14.

Figure 4E:
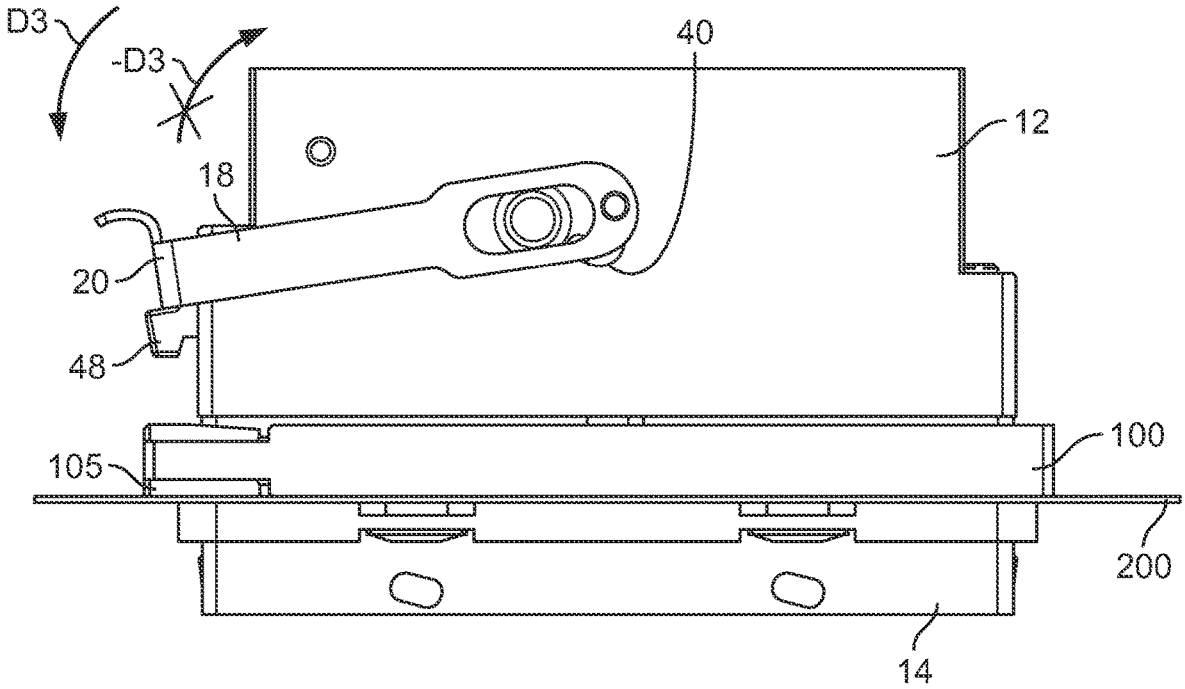
FIG. 4*e* is a side view of the electrical connector assembly in an assembled state.
Figure 5:
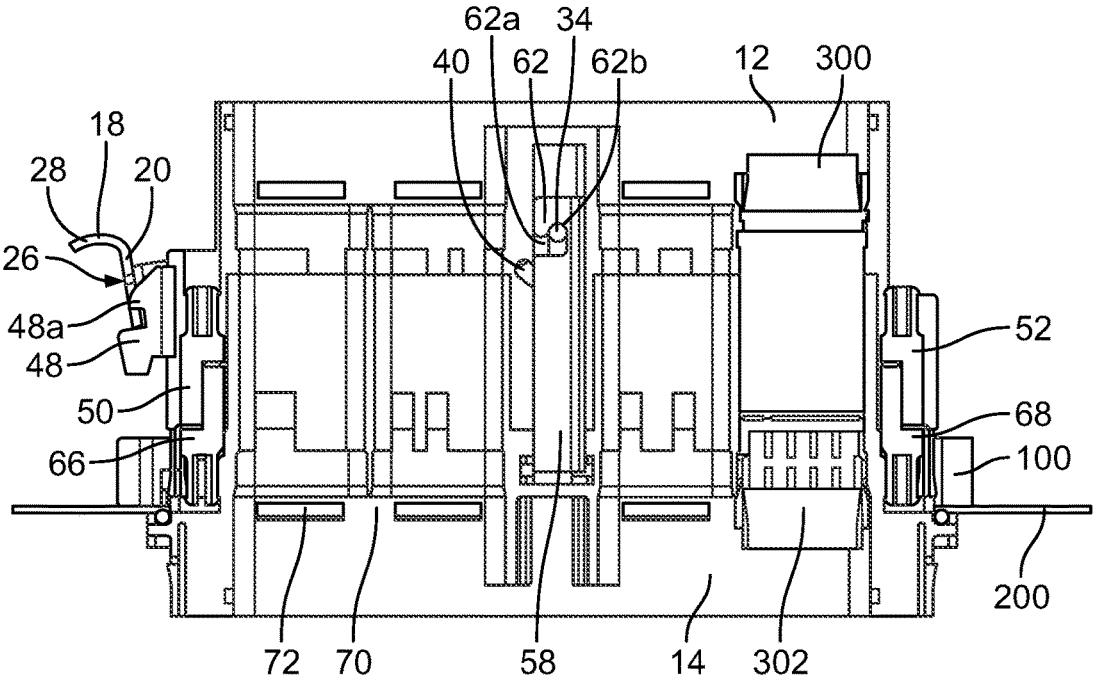
FIG. 5 is a partially transparent side view of the electrical connector assembly in the assembled state.

FIG. 4*e* represents the final step of the method for assembling the plug housing 12 to the receptacle housing 14. FIG. 5 represents a transparent view of the assembly represented in FIG. 4*e*. Hence, FIG. 4*a* and FIG. 5 will be described together in the following. At the final step, the module 300 of the plug housing 12 and the corresponding module 302 of the receptacle 14 are mated and locked together.

For arriving to the final step, the lever 18 has been further rotated along the direction D3 so that the shaft 34 abuts on the close-end 62*b* of the coupling hook portion 62 of the retaining device 58 (see view in FIG. 5) thereby maintaining the plug housing 12 and the receptacle housing 14 together by positive locking.

The central portion 20 of the lever 18 has partially passed over the locking button 48 so as to push (by springs not visible in FIGS. 4*e* and 5) the locking button 48 towards the plug housing 12 until a protruding portion 48*a* of the locking button 48 protrudes through the opening 26 of the lever 18, as can be seen in FIG. 5. Hence, the position of the locking button 48 illustrated in FIG. 5 corresponds to the locking position of the lever 18 by the locking button 48. A movement of the lever 18, in a direction—D3, i.e. in a direction opposite to the direction D3, is thus prevented by the abutment of the protruding portion 48*a* on the opening 26. A movement of the lever 18 in the direction—D3, allowing to unlock the lever 18, is only permitted when a user presses the locking button 48 so as to disengage the protruding portion 48*a* from the opening 26 of the lever 18.

At the final step illustrated in FIG. 5, the misplug mechanisms 50, 52 of the plug housing 12 are correctly connected with the corresponding misplug mechanisms 66, 68 of the receptacle housing 14.

Hence, the method for assembling the plug housing 12 with a receptacle housing 14 of an electrical connector assembly does not require the use of any screws or bolts. Therefore, the use of loose parts that have to be screwed can be advantageously avoided. The use, instead, of the lever's shaft 18, 34 and the retaining device 58 allow facilitating the assembly and the mating of such an electrical connector assembly 10. The use of a lever allows providing a more robust assembly than the known assemblies requiring fixing and/or coupling screws. Furthermore, one operator is enough for realizing the assembly with the lever. Moreover, there is no more need for a step wherein the torque applied to the screws is to be checked. Hence, the electrical connector assembly 10 allows reducing both the workforce and the assembly time, thus allowing reducing the cost for assembling such an electrical connector assembly 10. The method according to the present invention allows providing an easier, quicker and cheaper method for assembling an electrical connector assembly 10, in particular a scoop proof electrical connector assembly 10.

Although the embodiments have been described in relation to particular examples, the invention is not limited and numerous alterations to the disclosed embodiments can be made without departing from the scope of this invention. The various embodiments and examples are thus not intended to be limited to the particular forms disclosed. Rather, they include modifications and alternatives falling within the scope of the claims and individual features can be freely combined with each other to obtain further embodiments or examples according to the invention.

What is claimed is:

1. An electrical connector assembly, comprising:

a receptacle housing having a retaining device with a coupling hook portion; and a plug housing configured to be mated and locked with the receptacle housing, the plug housing having a lever movable from a first position in which the plug housing and the receptacle housing are unlocked to a second position in which the plug housing is locked with the receptacle housing, the lever is rotatably mounted about a shaft arranged in and passing through the plug housing, the coupling hook portion is configured to engage with the shaft and, in the second position, the shaft is in abutment with the coupling hook portion to positively lock the plug housing and the receptacle housing together.

2. The electrical connector assembly of claim 1, wherein the shaft is movably received through a pair of openings on a pair of opposite sides of the plug housing.

3. The electrical connector assembly of claim 2, wherein a cross-section of the openings transverse to a longitudinal axis of the shaft has a complementary shape to the coupling hook portion.

4. The electrical connector assembly of claim 3, wherein the cross-section of each opening transverse to the longitudinal axis of the shaft is a J-shape, the shaft abuts on a first end of each J-shape opening in the first position, and the shaft abuts on a second end opposite to the first end of each J-shape opening in the second position.

5. The electrical connector assembly of claim 1, wherein the lever has an oblong recess or an oblong through-hole and the plug housing has a protrusion, the oblong recess or the oblong through-hole cooperates with the protrusion to allow a movement of the lever relative to the plug housing from the first position to the second position.

6. The electrical connector assembly of claim 1, wherein the plug housing has a locking device locking the lever in the second position.

7. The electrical connector assembly of claim 6, wherein the locking device is spring loaded.

8. The electrical connector assembly of claim 7, wherein the locking device has a protruding portion abutting an opening of the lever in the second position and preventing a movement of the lever with respect to the plug housing.

9. The electrical connector assembly of claim 1, wherein the retaining device is snap-fitted to the receptacle housing.

10. The electrical connector assembly of claim 1, further comprising a fixation bracket frame having a securing clip, a dimension of the fixation bracket frame is adaptable from a primary position in which the securing clip is not or partially retracted with respect to the fixation bracket frame, so as to be mounted onto the receptacle housing, to a secondary position in which the securing clip is further retracted with respect to the primary position.

11. The electrical connector assembly of claim 10, wherein, in the secondary position, a panel is held between the receptacle housing and the fixation bracket frame.

12. The electrical connector assembly of claim 11, wherein the receptacle housing has a protrusion and the fixation bracket frame has a groove, the protrusion cooperates with the groove to allow a movement of the fixation bracket frame relative to the receptacle housing at least along two different directions not parallel to each other from an unfixed position to a fixed position, in the unfixed position a panel is not able to be held between the receptacle housing and the fixation bracket frame.

13. The electrical connector assembly of claim 12, wherein the fixation bracket frame has a securing clip movable relative to the fixation bracket frame between the unfixed position and the fixed position, the securing clip is snap-fitted to the fixation bracket frame in the fixed position.

14. A plug housing of an electrical connector assembly, comprising:

a lever movable from a first position in which the plug housing and a mating receptacle housing are unlocked to a second position in which the plug housing is locked with the mating receptacle housing, the lever is rotatably mounted about a shaft arranged in and passing through the plug housing, in the second position the shaft is in abutment with a retaining device of the mating receptacle housing to positively lock the plug housing and the mating receptacle housing together.

15. The plug housing of claim 14, wherein the shaft is movably received through a pair of openings on a pair of opposite sides of the plug housing, a cross-section of each of the openings transverse to a longitudinal axis of the shaft has a J-shape.

16. The plug housing of claim 15, wherein the shaft abuts on a first end of each J-shape opening in the first position, and the shaft abuts on a second end opposite to the first end of each J-shape opening in the second position.

17. A receptacle housing for an electrical connector assembly, comprising:

a retaining device having a coupling hook portion, the retaining device snap-fitted to the receptacle housing, the retaining device retaining a mating plug housing having a lever rotatably mounted about a shaft, the coupling hook portion engaging with and abutting the shaft of the mating plug housing to positively lock the receptacle housing and the mating plug housing together.

18. A method for assembling an electrical connector assembly, comprising:

providing a receptacle housing having a retaining device with a coupling hook portion;

providing a plug housing having a lever rotatably mounted about a shaft arranged in and passing through the plug housing;

assembling the plug housing to the receptacle housing to engage the shaft with the coupling hook portion; and moving the lever relative to the plug housing so that the lever abuts against the coupling hook portion.

19. The method of claim 18, further comprising:

mounting a fixation bracket frame and a panel around the receptacle housing; and moving and snap fitting a securing clip of the fixation bracket frame to maintain a panel between the fixation bracket frame and the receptacle housing.

20. The method of claim 19, wherein the mounting step includes pushing a protrusion of the receptacle housing into a groove of the fixation bracket frame.

* * * * *